US005133258A

United States Patent [19]

Rock et al.

[11] Patent Number: 5,133,258

[45] Date of Patent: Jul. 28, 1992

[54] NONPROPAGATING HOLDER AND PACKAGE FOR EXPLOSIVE DEVICES

[75] Inventors: Arthur O. Rock; Frank A. Niehaus, both of Washington; Ted A. Parker, Mitchell; Gennie F. Shrum, Worthington; Charles E. Phillips, Mitchell, all of Ind.

[73] Assignee: The United States of America as represented by the Secretary of the Navy, Washington, D.C.

[21] Appl. No.: 662,153

[22] Filed: Feb. 28, 1991

[51] Int. Cl.[5] ..... F42B 3/00; F42B 37/00

[52] U.S. Cl. ..... 102/331; 89/34; 206/3

[58] Field of Search ..... 102/331; 89/34; 206/3

[56] References Cited

U.S. PATENT DOCUMENTS

| | | | |
|---|---|---|---|
| 721,432 | 2/1903 | Durham | 102/331 |
| 1,517,294 | 12/1924 | Kowastch | 102/331 |
| 2,601,919 | 7/1952 | Darbyshire | 206/3 |
| 2,868,360 | 1/1959 | Donkin | 206/3 |
| 3,058,419 | 10/1962 | O'Brien | 102/331 |
| 3,713,360 | 1/1973 | Shansey | 102/331 |
| 3,757,933 | 9/1973 | Banta | 206/3 |
| 4,036,138 | 7/1977 | Chopra et al. | 102/331 |
| 4,199,057 | 4/1980 | Gruaz | 206/3 |
| 4,222,484 | 9/1980 | Howe | 206/3 |
| 4,248,342 | 2/1981 | King et al. | 206/3 |
| 4,440,296 | 4/1984 | Howe et al. | 206/3 |
| 4,763,576 | 8/1988 | Kass et al. | 102/331 X |
| 4,838,168 | 6/1989 | Manion et al. | 102/331 X |

FOREIGN PATENT DOCUMENTS

| | | | |
|---|---|---|---|
| 46445 | 6/1888 | Fed. Rep. of Germany | 89/34 |

*Primary Examiner*—Peter A. Nelson
*Attorney, Agent, or Firm*—William C. Townsend

[57] ABSTRACT

Safe transportation holder and package for explosive devices such as blasting caps. Each cap is contained in an internal cavity in a holder, and surrounded by radially-spaced, elastomeric walls. The holders are arrayed in a container, and absorb the energy released by accidental detonation of one cap to prevent sympathetic detonation of others in the package.

16 Claims, 2 Drawing Sheets

NONPROPAGATING HOLDER AND PACKAGE FOR EXPLOSIVE DEVICES

BACKGROUND OF THE INVENTION

Presently utilized packaging for small quantities of blasting caps comprises a cardboard box in which the caps are packed in contact with one another. This is disadvantageous in that accidental detonation of one cap in the box results in sympathetic detonation of others, producing in the aggregate a violent explosion that far exceeds the power released by a single cap. Among other undesirable aspects of this condition, the cost of shipping caps thus packaged is very high. Although such packs are cushioned and placed, along with like packs, in a strong metal container which in turn is placed in an exterior wooden box along with other, like containers, the exterior boxes are still charged the high rates for Class A explosives rather than the lower rates available for less hazardous, Class C explosives.

Accordingly, a main object of the invention is to provide improved packaging for explosive devices that overcomes the deficiencies of the prior art.

Another object of the invention is the provision of an improved package for blasting caps that contains the energy released by accidental detonation of one cap so as to avoid sympathetic detonation of other caps in the package.

Still another object of the invention is the provision of improved packaging for blasting caps that is entitled to reduced shipping costs.

Other objects and advantages of the invention will appear from the following detailed description which, together with the accompanying drawings, discloses two embodiments of the invention for purposes of illustration only. For definition of the scope of the invention, reference will be made to the appended claims.

Figure 2:
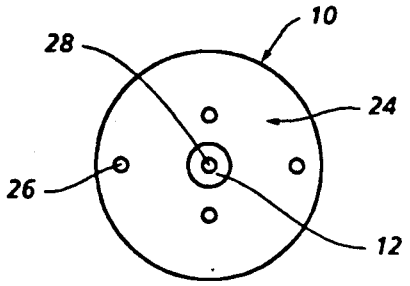
FIG. 2 is a top view of the holder of FIG. 1.
Figure 3:
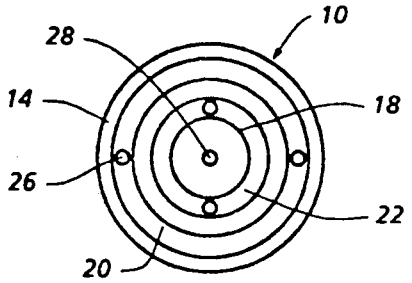
FIG. 3 is a bottom view of the holder of FIG. 1.
Figure 1:
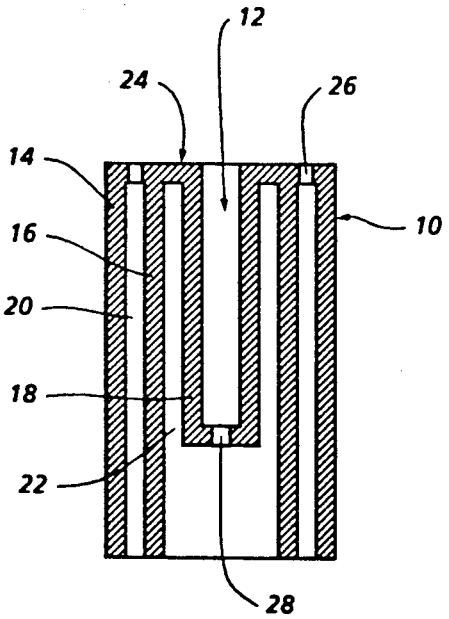
FIG. 1 is a side cross-sectional view of a nonpropagating blasting cap holder embodying principles of the invention.
Figure 4:
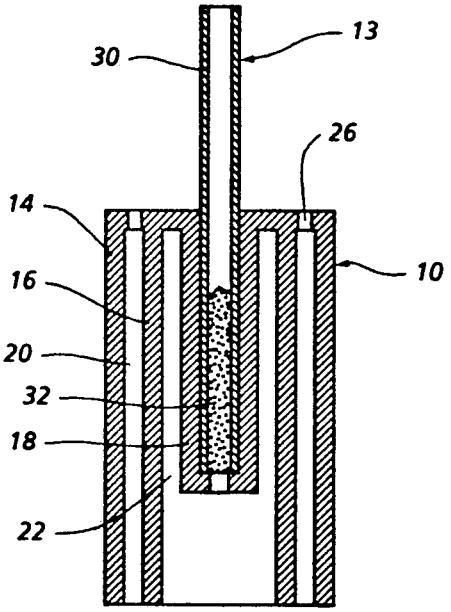
FIG. 4 depicts the holder of FIG. 1 with a blasting cap in position in the holder.

Primed reference characters, where employed, denote elements similar to the elements designated by the corresponding unprimed characters.

DETAILED DESCRIPTION OF THE PREFERRED EMBODIMENTS

Referring to FIGS. 1–4, a nonpropagating holder for a blasting cap is generally indicated at 10. The holder comprises an internal, central cavity 12 for containing an explosive device in the form of a blasting cap 13. Holder 10 also comprises a plurality of concentric, cylindrical walls 14, 16, 18 that circumscribe cavity 12 and are spaced radially from one another by concentric, cylindrical spaces or air gaps 20, 22. The concentric walls and radial spaces coact to contain the explosive forces of detonation of a blasting cap in cavity 12 and thereby prevent propagation of the detonation to other like-packed caps. Put another way, the walls and free spaces between the walls of the holder function to absorb the energy released by an exploding blasting cap, so as to avoid sympathetic detonation of others.

To promote energy absorption by the walls it is preferred that they be made of an elastomer. Walls of elastomeric material have been observed to undergo radially-outward expansion under the forces released by an exploding blasting cap and thus contribute materially to the confinement of such forces. The wall/space coaction also works in a radially inward direction when holders are packed contiguously in a manner to be described, as the walls flex inwardly in response to the outward expansion of a contiguous holder containing an exploding cap, to absorb further energy of the explosion and contribute to preventing it from reaching and detonating the cap contained within the inwardly-flexing holder.

The preferred elastomer is urethane, which has the requisite combination of structural strength, rigidity and elasticity to function successfully throughout the range of temperatures to which blasting caps packed for worldwide shipment and usage may be exposed. This range is from about −65° F. to about +160° F. Urethane is available commercially from the General Polymers Division of the Ashland Chemical Company, in Columbus, Ohio, as well as other sources. Urethane has as physical properties an ultimate tensile strength of about 6250 pounds per square inch (psi), about 475% elongation, Shore A test hardness of about 90, a tensile modulus of about 3430 psi at 300% elongation, a compression set of about 25–40% and an elongation set of about 25–80%. However, it will be appreciated that the holder may be made of any material that is suitable for the purpose. It has been found that urethane walls about one-eighth inch in thickness, separated by free air spaces also about one-eighth inch in span, are effective to contain the energy of an exploding blasting cap and prevent propagation in a holder that measures about 1.5 inches in diameter and about 2.5 inches in length, where the cap contains about 943 milligrams (mg) symcyclotrimethylene trinitramine (an explosive commonly termed RDX), 240 mg lead azide primer, and 56 mg lead styphnate as an igniter, which sum to a net explosive weight of about 1239 mg. It is preferred that holder 10 be injection-molded in one piece, but it will be appreciated that the holder may be assembled from individual components joined together with an appropriate cement.

In holder 10, the concentric walls are held in radially spaced relation to each other and to form or define the interleaved radial spaces by virtue of being formed integrally with top end wall 24. The interwall spaces communicate with the ambient atmosphere by virtue of being open at the bottom end of the holder. In the embodiment illustrated the spaces also communicate with the atmosphere through holes, as 26, in top end wall 24. Formation of holes 26 may be convenient or necessary for the particular injection molding process used to make the holder, but it will be appreciated that holes 26 are optional and unnecessary to the successful practice of the invention. Cavity 12 is open at the top end portion for insertion and removal of blasting cap 13, and also communicates with the atmosphere through hole 28 in the bottom end wall of the cavity. Hole 28 is like holes 26 in being optionally formed in the injection molding process. Blasting cap 13 is conventional, and includes a cylindrical, thin-walled aluminum tube 30 having an empty handle portion that protrudes from cavity 12. The cap also has a lower portion that is packed with explosive powder 32 within the protective surrounding walls of the holder.

Figure 5:
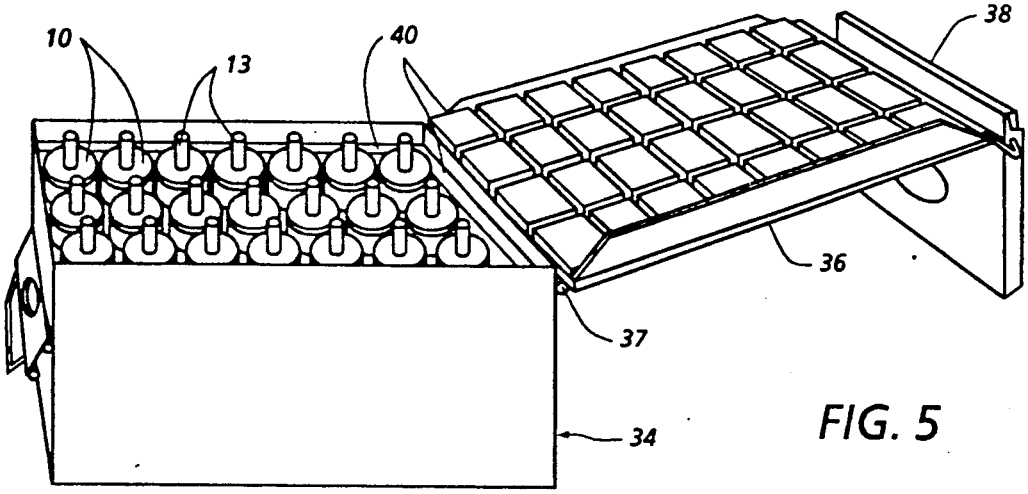
FIG. 5 is a perspective view of a package embodying principles of the invention, showing an array of nonpropagating holders and blasting caps in place.

FIG. 5 shows a plurality of nonpropagating holders 10 contiguously arrayed within a sheet steel container 34 having a lid 36 shown in open position and hingedly attached at 37 to the container body. Latch 38 is provided to secure the lid in closed position. The container, including lid 36, is lined with foamed polyethlylene, as at 40, to encase the array of holders and blasting caps and cushion them from impacts during handling and shipment of the container. Other suitable cushioning materials may also be utilized. In the embodiment of FIG. 5 there are two layers of arrayed nonpropagating holders. Only the top layer is shown. The bottom layer is identical to the top layer, however, and is separated therefrom by a layer of foam cushioning. It is contemplated that container 34 may be packed, along with like containers, in a cushioned, exterior wooden box for shipment. Container 34, however, itself constitutes a safe transportation or handling package for small quantities of blasting caps.

Figure 7:
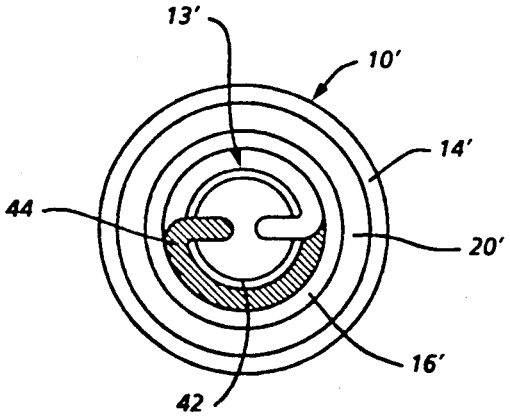
FIG. 7 is a top view of the holder of FIG. 6.
Figure 6:
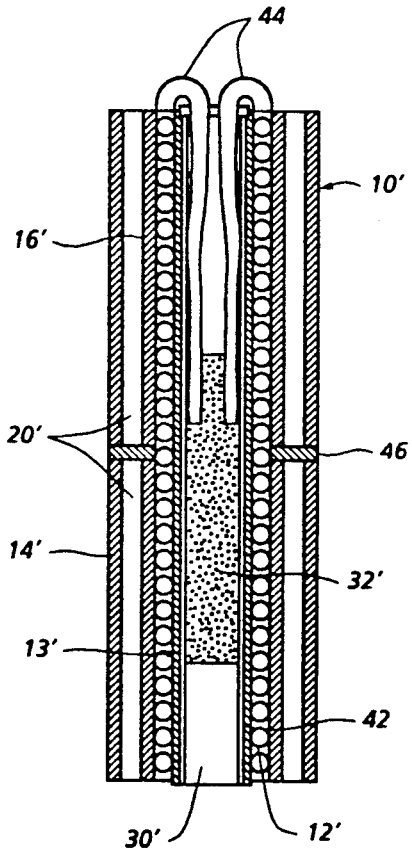
FIG. 6 is a side cross-sectional view of another blasting cap holder embodying principles of the invention.

The holders thus far described are particularly adapted for nonelectric blasting caps. The holder 10' depicted in the embodiment of FIGS. 6–7 is adapted for electric blasting caps 13', which are similar in construction to the nonelectric caps previously described. However, electric caps also comprise an encasing cardboard or fiberboard tube 42 with the lead wires 44 of the electric cap coiled around the tube. Thus, the electric cap requires a larger-diameter internal cavity 12' to receive the cap, fiberboard tube and coiled wires. At the same time, the tube and coiled lead wires contribute an energy-absorbing function such that holder 10' requires fewer walls and free spaces than the previously-described holder for nonelectric caps. Cavity 12' in holder 10' is open at both ends for insertion and removal of the cap.

Holder 10' comprises an inner wall 16' and an outer wall 14' that is spaced radially from the inner wall so as to form an air gap 20' that is open to the atmosphere at both ends of the holder. Each wall 14', 16' is of two-part construction and is maintained in radially spaced relationship with respect to the other wall to form air gap 20' by virtue of the wall parts being bonded to base ring 46. Stated otherwise, wall 14', for example, comprises an upper cylindrical portion and a lower cylindrical portion and these two cylinders are joined, in axial alignment with one another, by ring 46.

Although the invention has been described in connection with two embodiments, such are not to be taken as limiting the principles of the invention as defined by the appended claims.

We claim:

1. A safe-transportation package of explosives, comprising a container, and a plurality of nonpropagating holders disposed in the container, each holder having an internal cavity containing an explosive device, each holder including means defining a plurality of successive, radially-spaced walls around the cavity for containing explosive forces of detonation of the explosive device in the cavity and thereby preventing propagation of the detonation to other explosive devices in the container.

2. The package of claim 1, in which the space between the walls is filled with air.

3. The package of claim 1, in which the walls are made of an elastomer that is effective to contain the explosive forces throughout a temperature range of from about −65° F. to about +160° F.

4. The package of claim 1, including impact-cushioning means lining the container and encasing the plurality of holders

5. A safe-transportation package of explosives, comprising a container, and a plurality of nonpropagating holders contiguously arrayed within the container, each holder having an internal cavity containing an explosive device, the cavity having an open end portion for insertion and removal of the explosive device, each holder including means defining a plurality of generally concentric, radially-spaced walls around the cavity for containing explosive forces of detonation of the explosive device in the cavity and thereby preventing propagation of the detonation to other explosive devices in the container, the radial space between the walls being filled with air.

6. The package of claim 5, in which the walls are made of an elastomer that is effective to contain the explosive forces throughout a temperature range of from about −65° F. to about +160° F.

7. The package of claim 6, including impact-cushioning means lining the container and encasing the array of holders.

8. The package of claim 7, in which each holder includes a plurality of air spaces radially separated by a wall.

9. The package of claim 7, in which the walls and the space between the walls have a generally cylindrical configuration.

10. The package of claim 9, in which the explosive device is a blasting cap.

11. A nonpropagating holder for an explosive device, comprising means defining an internal cavity for containing an explosive device, means defining a plurality of radially-spaced walls around the cavity for containing explosive forces of detonation of an explosive device in the cavity and thereby preventing propagation of the detonation, the radial spacing of the walls defining a space between radially adjacent walls, the space being filled with air.

12. The holder of claim 11, in which the walls are made of an elastomer that is effective to contain the explosive forces throughout a temperature range of from about −65° F. to about +160° F.

13. The holder of claim 12, in which the elastomer is urethane.

14. The holder of claim 11, in which the walls and spaces between walls have a generally concentric cylindrical configuration.

15. The holder of claim 11, in which the cavity has an open end portion for insertion and removal of the explosive device.

16. The holder of claim 11, in which the explosive device is a blasting cap.

* * * * *